US006321386B1

(12) United States Patent
Monica

(10) Patent No.: US 6,321,386 B1
(45) Date of Patent: Nov. 27, 2001

(54) HEAT DEFLECTION AND RETAINING APPARATUS

(76) Inventor: Mark D. Monica, 8 Westerly Ave., Madison, NJ (US) 07940

( * ) Notice: Subject to any disclaimer, the term of this patent is extended or adjusted under 35 U.S.C. 154(b) by 0 days.

(21) Appl. No.: 09/120,424

(22) Filed: Jul. 22, 1998

Related U.S. Application Data

(60) Provisional application No. 60/053,413, filed on Jul. 22, 1997.

(51) Int. Cl.[7] ..... A42B 3/04
(52) U.S. Cl. ..... 2/7; 2/412; 2/425
(58) Field of Search ..... 2/410, 411, 412, 2/424, 425, 5, 7

(56) References Cited

U.S. PATENT DOCUMENTS 3,442,750 * 5/1969 Wilcox ..... 161/57
4,271,537 * 6/1981 Bowlus et al. ..... 2/424
4,397,045 * 8/1983 Schonwetter et al. ..... 2/5
4,619,003 * 10/1986 Asbury ..... 2/5
4,780,347 * 10/1988 Cohen ..... 428/36
4,912,778 * 4/1990 Daniels ..... 2/7
4,982,451 * 1/1991 Graham ..... 2/410
5,548,846 * 8/1996 Bianchetti ..... 2/209.12
5,552,451 * 9/1996 Everaerts et al. ..... 522/46
5,630,230 * 5/1997 Fujino et al. ..... 2/200.1
5,750,225 * 5/1998 Petty ..... 428/362
5,797,146 * 8/1998 Matich ..... 2/424
5,875,493 * 3/1999 MacDonald et al. ..... 2/172

* cited by examiner

*Primary Examiner*—Michael A. Neas
(74) *Attorney, Agent, or Firm*—Paul A. Schwarz, Esq.; Duane, Morris & Heckscher LLP

(57) ABSTRACT

Radiant heat deflection system for use when a person is subjected to high temperature conditions during athletic activity. The heat deflection system is capable of deflecting radiant away from the wearer's head or body, thereby reducing the amount of heat absorbed by the person. The invention also relates to heat retaining inserts and apparatus for use during athletic activity, to increase heat retention in cold temperatures.

19 Claims, 10 Drawing Sheets

HEAT DEFLECTION AND RETAINING APPARATUS

This application claims the benefit of U.S. Provisional Application No. 60/053,413 entitled "Heat Deflection and Retaining Apparatus", filed by applicant on Jul. 22, 1997.

FIELD OF THE INVENTION

The present invention is directed to heat deflection apparatus, and heat retaining apparatus for athletes and sportspersons (collectively "persons").

BACKGROUND OF THE INVENTION

Heat is never really lost, but is instead transferred or altered in some fashion. Heat can be transferred in three ways:

(i) Conductive Heat: The direct flow through a solid object from hot to cold. For example, when one sticks a hand in the snow, the snow gets warmer and melts and the hand gets colder.

(ii) Convective Heat: The continuous movement of air or water transferring heat. Heat flow is generally never downward when air is warmed. As warm air expands, it becomes less dense and it rises.

(iii) Radiant Heat: The flow of invisible infra-red rays emitting from the surface of an object, due to the heat from within. All objects give off radiant heat, called radiation. Sunshine is a source of radiant energy. Radiation is also the form of heat transfer which most affects the comfort level of buildings, and is the primary source of human discomfort.

Body heat is lost by all three of types of heat transfers.

Radiant energy travels through space without heating the space itself It only turns into heat when it comes into contact with a cooler surface. The longer an object is exposed to radiant heat, the hotter it becomes. Although it is commonly believed that air temperature alone affects human comfort levels, radiant heat transfer can have an equal effect on temperature levels.

Radiant Barrier Technology (RBT) consists of an airspace with one or more of its boundaries functioning as a radiant barrier. Radiant barriers are made of materials that restrict the transfer of infrared radiation across an airspace. This is accomplished by reflecting the radiation that strikes the barriers, and at the same time, not radiating heat energy. A material that inhibits radiative transfer in this manner is said to have a very low emissivity (the relative power of a surface to emit heat by radiation). The lower the emissivity, the better the radiant barrier. For this reason, the barrier can be placed on either upper or lower surfaces of the object. One side reflects while the other side simply decreases the amount of emitted radiation. Moreover, it is not necessary to form airtight seals with radiant barriers.

Radiant heat is the major contributor to the heat load imposed on an athlete by the environment, and excessive exposure to heat will affect even the best conditioned athlete, hindering their performance, and increasing the potential for possible injuries. Convective heat transfer adds to this radiant heat. Heat-protective clothing is currently not used by athletes because such clothing greatly restricts the potential for body heat loss via evaporation. The athlete experiences a heat load which is determined by the time spent on the field, the intensity of play, the clothing worn and the air circulation on the field as well as the environment. If the heat load is sufficiently severe, detrimental effects on the players health and performance will occur. These range from decreased concentration to painful cramps, fainting, heat exhaustion and heatstroke. These signs and symptoms require immediate medical attention. Thermal comfort is determined by: (i) the air temperature, (ii) the median radiant temperature, (iii) air velocity, (iv) humidity in the air, (v) level of activity, and (vi) the clothing an individual is wearing.

Just as an athlete suffers in heat, athletes also suffer in extreme cold. When cold exposure lasts for more than an hour, cooling of the skin and reduced blood flow to the hands, for instance, leads to blunted sensations of touch and pain and loss of dexterity and agility. Numbness, frostbite, and even hypothermia are all possible dangers associated with extreme cold.

Non-freezing cold injuries can occur when conditions are cold and wet (between 32° F. and 55° F.). The most prominent are chilblain and trenchfoot. The most life-threatening is hypothermia. This occurs when deep body (core) temperature falls below 95° F. Hypothermia victims may show no heartbeat, breathing, or response to touch or pain, and untreated, hypothermia can result in death. Symptoms include withdrawn or bizarre behavior, irritability, confusion, slowed or slurred speech, altered vision, uncoordinated movement and unconsciousness. Even mild hypothermia can result in impairment of decision-making abilities. Cold injuries occur whenever air temperature is below freezing (32° F.). Freezing of the skin surface is termed 'frostnip', deeper freezing through the skin and flesh is termed 'frostbite'.

If the wind is blowing, an athlete will lose heat faster and will feel colder because the wind is evaporating the moisture on his or her skin, and blows away the layer of warm air around their body. In an open air sport stadium, for example, a 20 mph wind can make a 5° F. day to feel like −31° F.

The human body has biological defense mechanisms to help maintain proper body temperature. These include vasoconstriction (the tightening of blood vessels in the skin to reduce blood flow to conserve body heat) which leads to discomfort, numbness, loss of dexterity and eventually injury and shivering, which increases internal heat production to help offset lost heat. Internal heat production is increased by physical activity. The more physical the activity, the greater the heat production. In fact, heat production during intense exercise is usually sufficient to completely compensate for heat loss in extreme cold. However, high intensity exercise is fatiguing and causes sweating and cannot be maintained for long periods of time.

The majority of heat loss is through the head. In football helmets, for example, there is no insulation present to protect from extreme cold. Presently, players put athletic tape over the ear holes in an attempt to cut down on the cold wind swirling inside their helmet, but this results in a loud noise in the helmet, as well as freezing ears. Because the rear and front of the helmet are open, the tape does nothing to keep the wearer's ears from freezing and does very little to cut down on the noise produced by the wind once it has entered the helmet. This is the extent of cold-weather protection for helmets.

There is thus a need to provide athletes with a wearable device to protect from radiant heat. There is also a need to provide athletes with insulation and protection from extreme cold in their helmets.

SUMMARY OF THE INVENTION

The present invention relates to a heat deflection system for use when a person is subjected to high temperature conditions while performing a physical activity, such as an athletic sport. High temperature conditions include those temperatures which may cause discomfort or physical injury to the person.

The invention also relates to a heat retaining apparatus effective when temperatures are low enough to cause adverse effects on the person's health, comfort, or performance.

Both aspects of the present invention are accomplished by novel apparatus, or by novel inserts which can be incorporated into existing helmets, padding, or clothing.

BRIEF DESCRIPTION OF THE FIGURES

FIG. 1 is a side view of the protective helmet having the heat retention elements.

FIG. 2 is a rear ¾ view of the protective helmet having the heat retention elements.

FIG. 3 is a rear ¾ view (close-up) of the protective helmet having the heat retention elements.

FIG. 4 is a front ¾ view of the protective helmet having the heat retention elements.

FIG. 5 is a top ¾ view of the protective helmet having the heat retention elements.

FIG. 6 is a top view of the protective helmet having the heat retention elements.

FIG. 7 is a side and rear ¾ view of the protective helmet having the heat retention elements.

DETAILED DESCRIPTION

Heat Deflection

Figure 1:
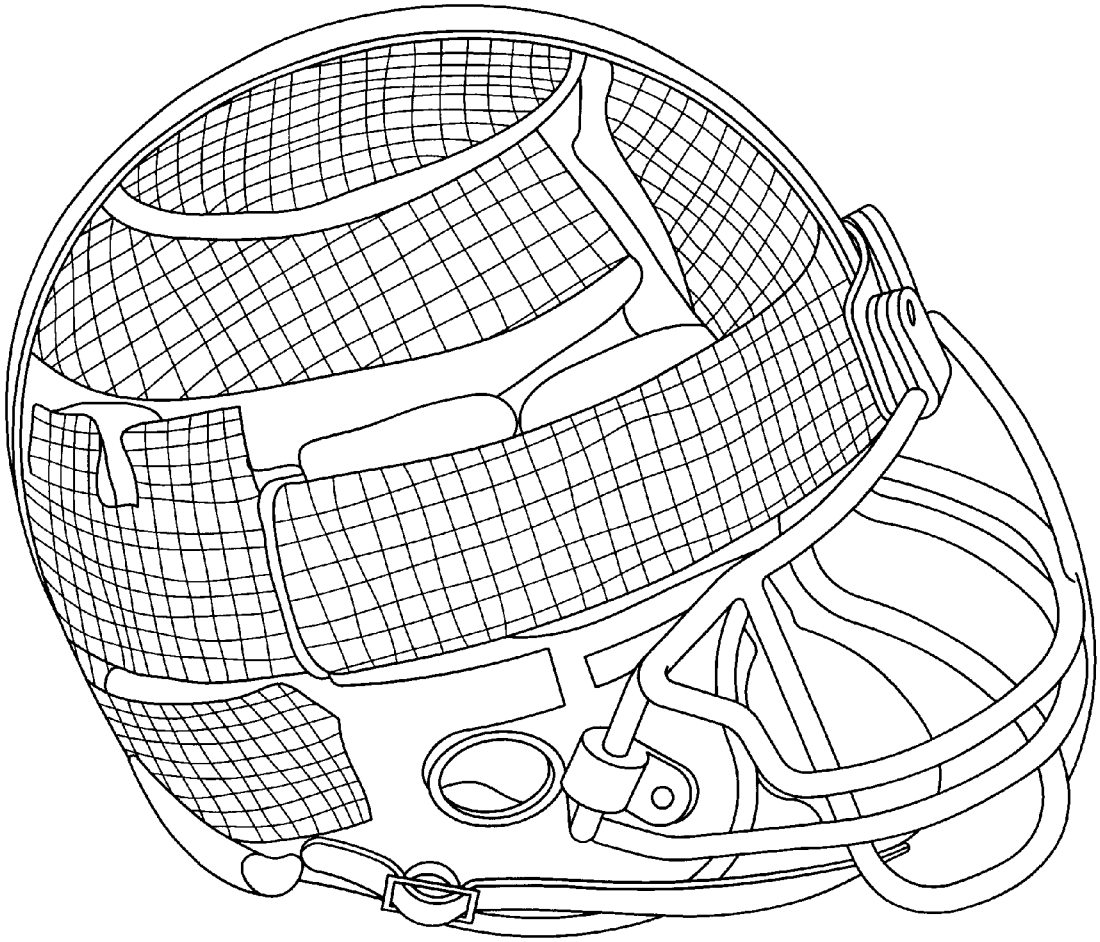
FIGS. 1–7 show a protective helmet having the heat retention elements.
Figure 2:
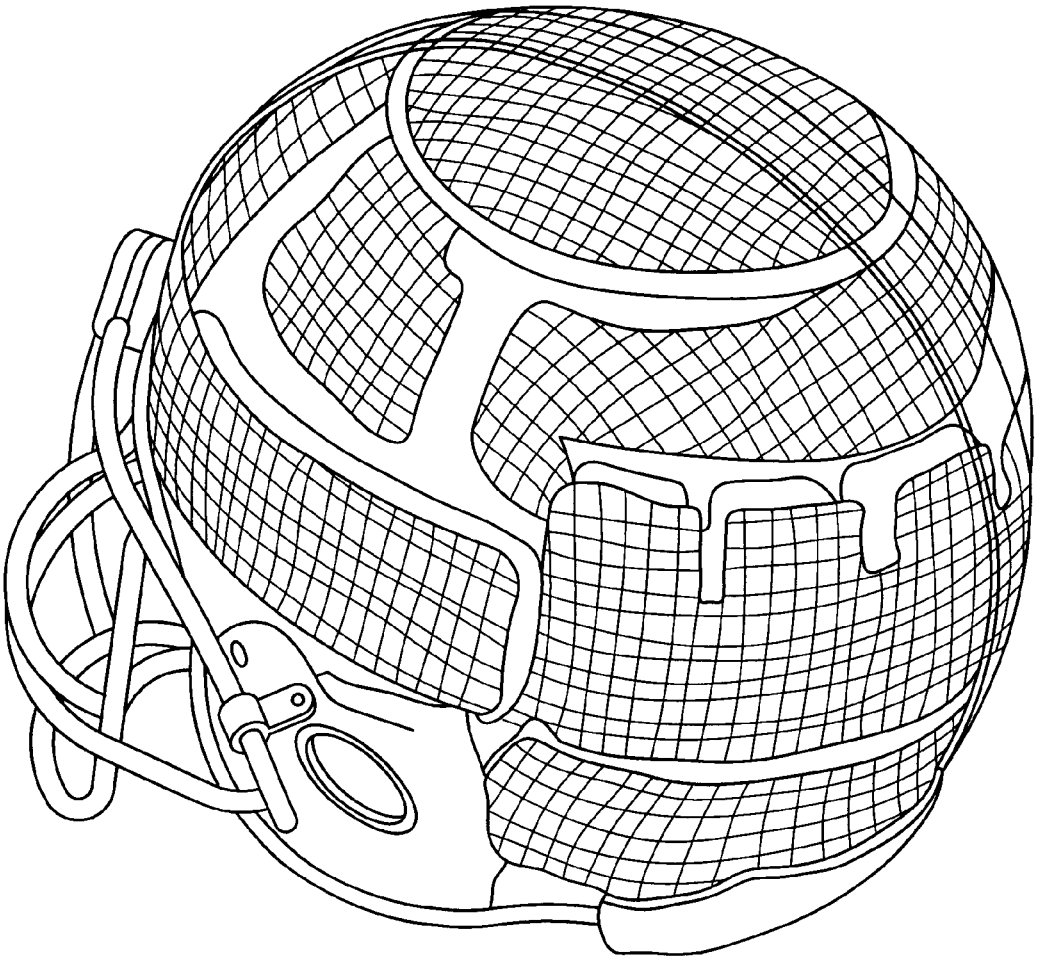
Figure 3:
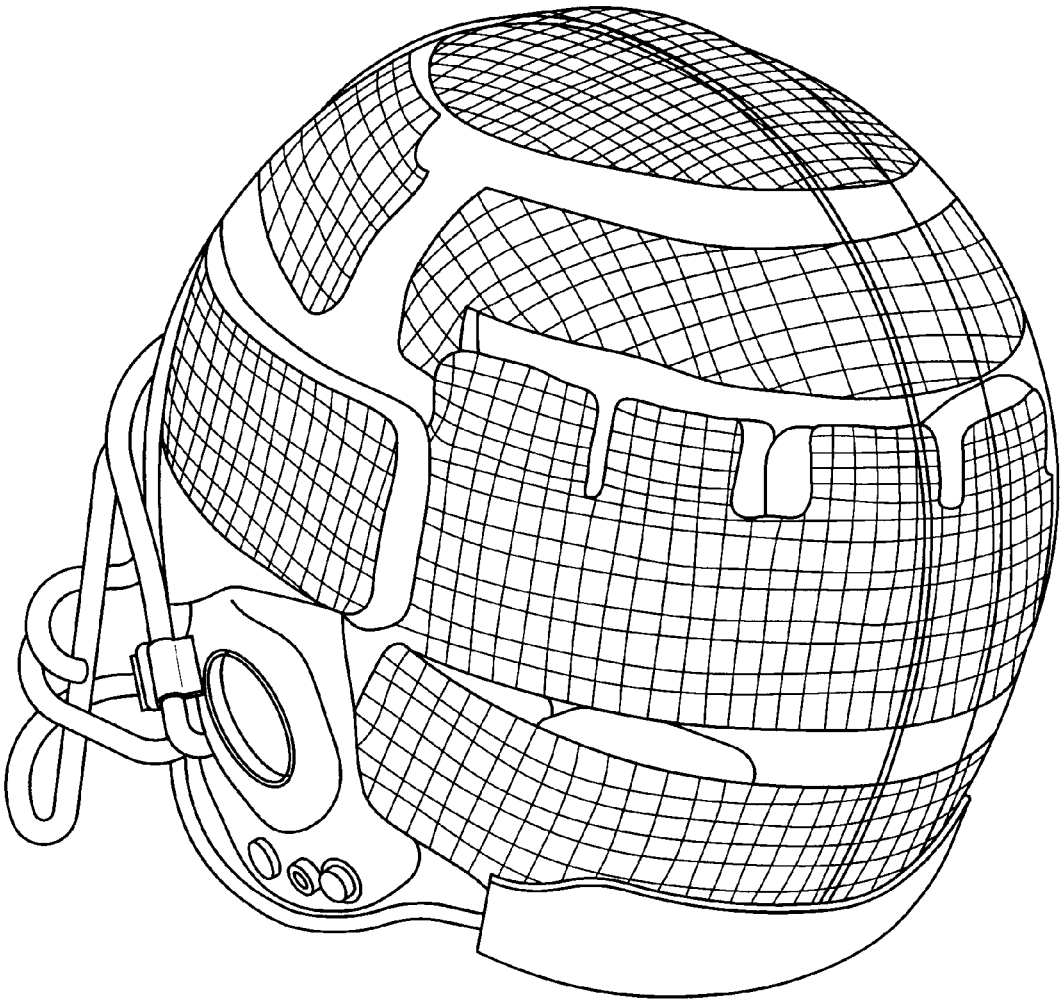
Figure 4:
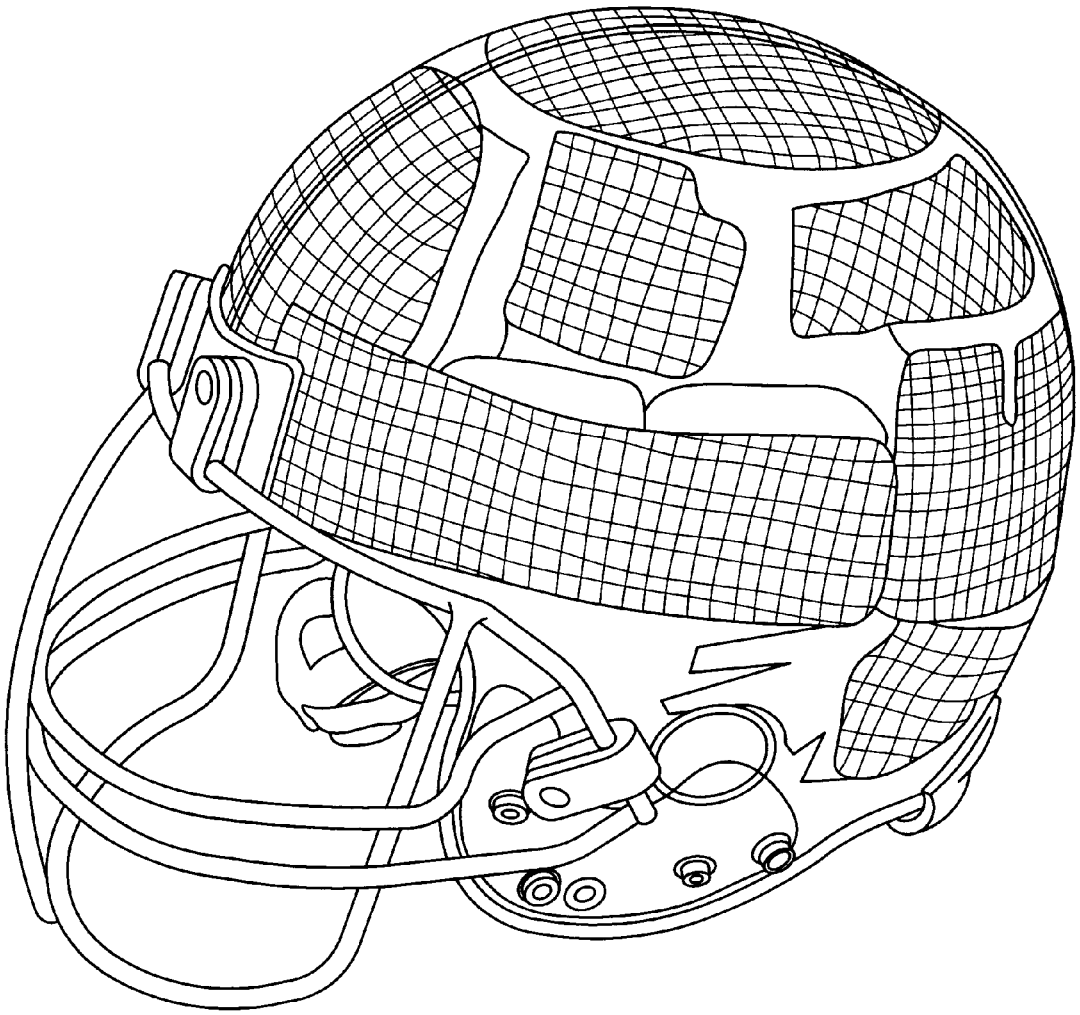
Figure 5:
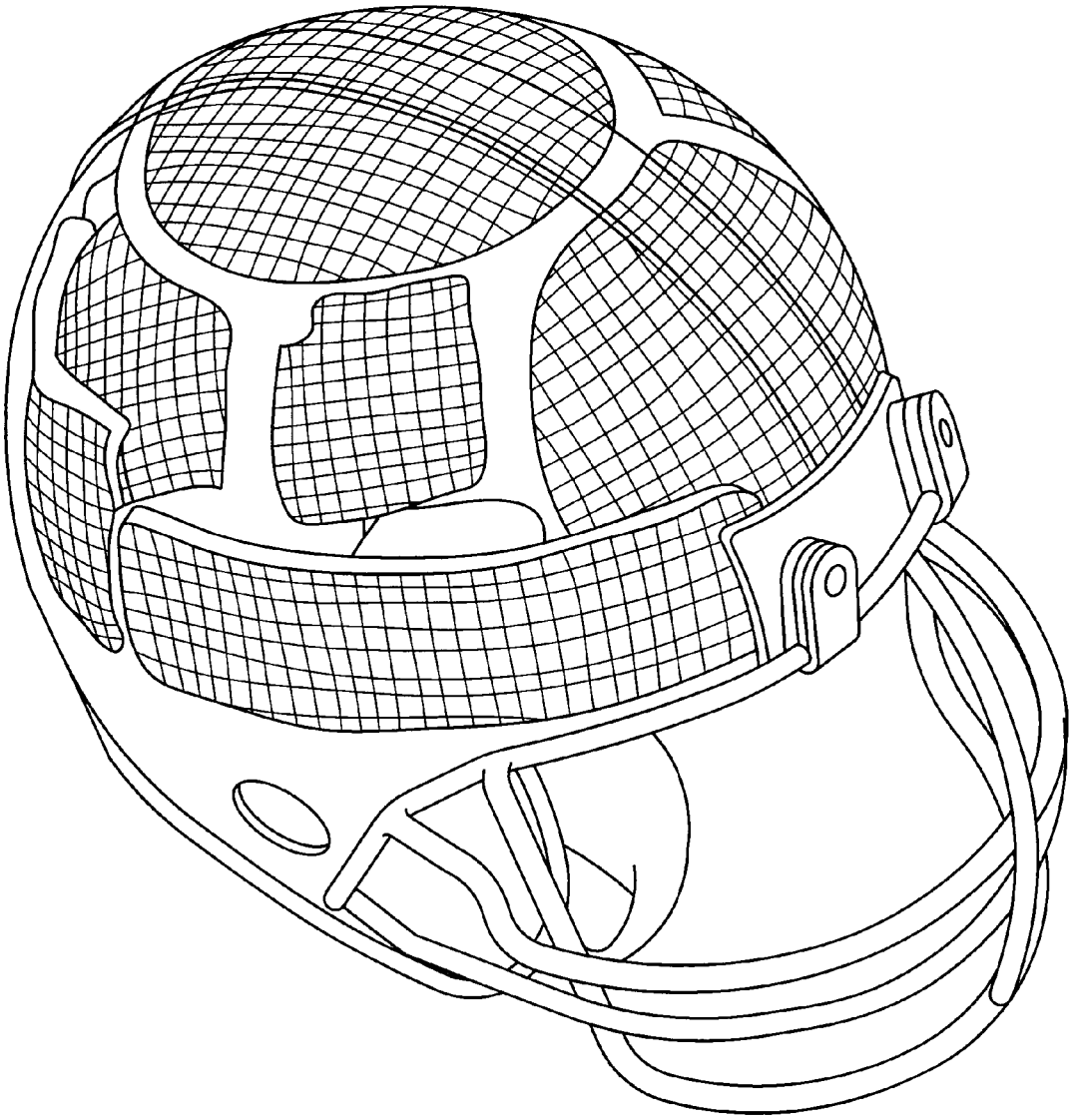
Figure 6:
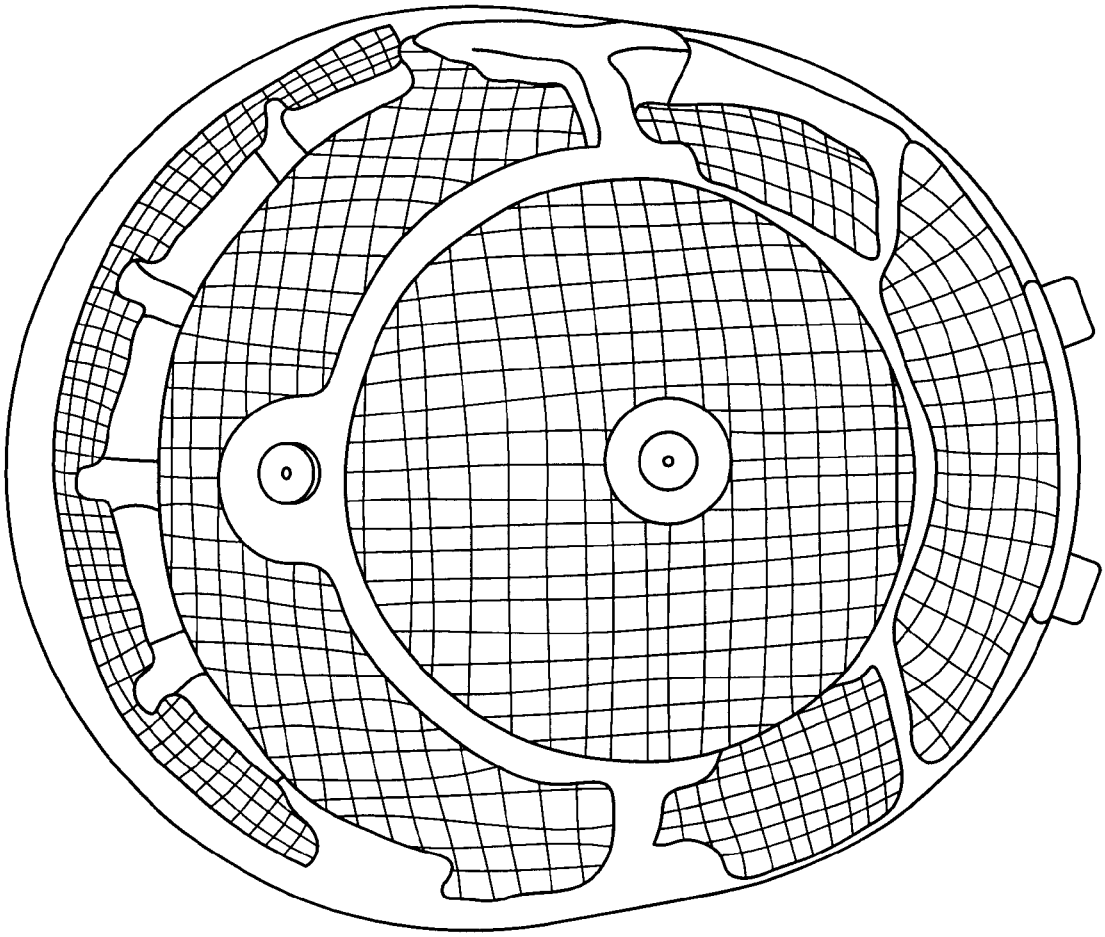
Figure 7:
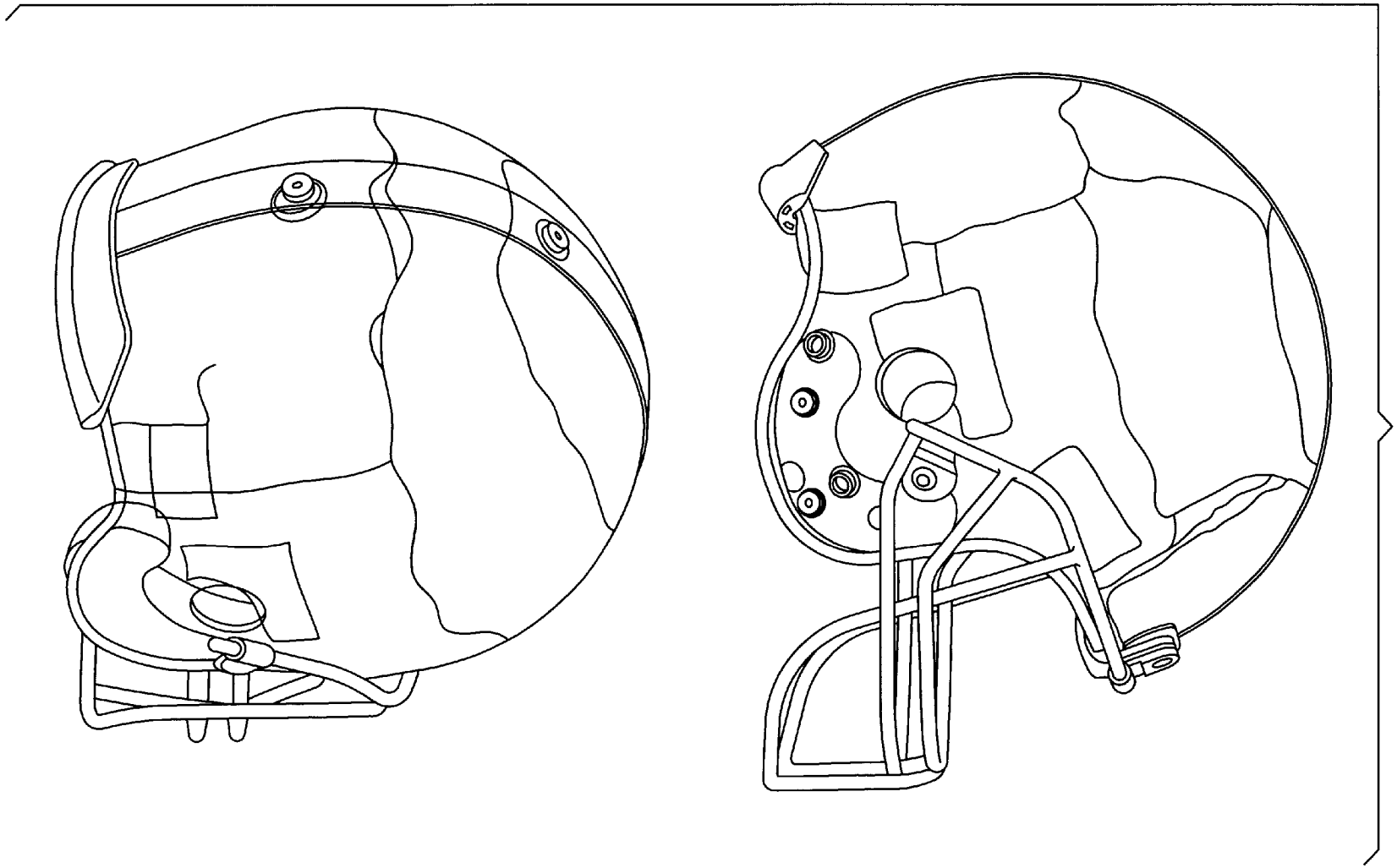

The heat deflection aspect of the invention comprises a substrate having at least one layer of heat deflection material. As used herein, the term, "deflection" refers to the deflection, redirection, or reflection of radiant heat energy.

The heat deflecting elements are adapted substantially to the shape of, and are formable within, athletic helmets, clothing, or pads such that when radiant heat is directed toward the person, it is deflected away from the person's head or body, thereby reducing the amount of heat absorbed by the person. To accomplish this, the radiant heat deflecting elements face away from the body. It will be appreciated that the heat deflecting elements may be permanently secured to pre-existing equipment (such as helmets, protective pads, or clothing) or may be a removable insert for such equipment. For helmets applications, it will be appreciated that the heat deflecting means can also be a heat deflecting coating (such as a liquid-applied coating, laminate, or otherwise) which is applied directly to the interior portion of the protective helmet. In accordance with the invention, the heat deflecting means can be similarly applied to the helmet pads, bladders, or other internal helmet components.

The radiant heat deflection element is preferably made of an aluminum-based material. Industrial grade aluminized polyester is preferred, however other suitable aluminum materials may be used. It has been found that the industrial grade aluminized polyester heat deflection material in accordance with the invention is capable of reflecting up to 97% of radiant heat.

In a preferred embodiment, the heat deflection aspect comprises two sheets of 99.5% pure industrial grade aluminum foil with a fiberglass scrim reinforcement (for maximum tensile strength) laminated to a cotton/polyester pressure sensitive adhesive tape for easy removal. The foil has been found to reflect 97% of radiation heat up to 700° F.

Athletic Helmet Application

By way of example, the heat deflection system components can be die cut for placement into football helmets based upon the interior specifications specific for that model helmet. The heat deflection components can be disposed directly on the interior portion of the helmet, or secured to the helmet pads themselves (with the heat deflection material facing the interior portion of the helmet). The components may also be laminated to a variety of materials including polyester backing, transfer tape, or any other suitable backing material. The heat deflection components can further be laminated to padding having excellent acoustical properties. In this embodiment, ⅜ inch acoustic padding is preferred. The heat deflection components are located on the inside of the helmet, but do not touch the player's head. The padding is preferably placed over the heat deflection components, so that the heat deflection components are directly underneath the polycarbonate alloy shell.

Ordinarily, when a helmet shell absorbs heat, that heat in turn is then absorbed by the interior padding that touches the players head by conductive heat transfer, because it is touching the helmet shell. The heat deflection components deflect the radiant heat directed at the helmet, prohibiting heat absorbed by the helmet shell from entering any further. The heat deflection system does not interfere with the fit of the helmet and does not alter the helmets protective capabilities in anyway.

The figures herein set forth a football helmet having a translucent shell. Although the shell is translucent in the figures, the present invention is not limited to this feature and may include a helmet having an opaque shell. As can be seen from the figures, the heat deflection elements are sized within the helmet on the outer side of conventional helmet cushions. The heat deflection elements may consist of a single piece which covers the entire interior of the helmet or clothing or may be made in pieces as shown in the figures.

Other suitable applications include baseball hats, baseball batting helmets, lacrosse helmets, motorcycle helmets, bicycle helmets, hockey helmets, auto racing helmets, and any other suitable application where heat reflection is desired.

Athletic Pad Application

The heat deflection system components can also be used in a wearer's pads and clothing. Using football shoulder pads as an example, the heat deflection system components can comprise the foil alone placed on the pad itself, or the foil can be laminated to a suitable natural or synthetic material, including but not limited to, polyester materials and blends, cotton, wool, nylon, fiberglass RAYON™, KEVLAR™, SPANDEX™, synthetic fiber, and the like.

The heat deflection components can also be laminated to padding materials, including open cell foam (such as urethane), closed cell foam (such as vinyl nitrites), or EVA foam. These foams are commonly used in shoulder pad manufacturing. With the laminated padded version, this material may be incorporated into existing padding for added protection that does not change the look or protective ability of the pad itself. The end result is a cooler body temperature because of radiant heat reflection, and a warmer body during the winter months because of the added insulation in the padding.

Figure 8:
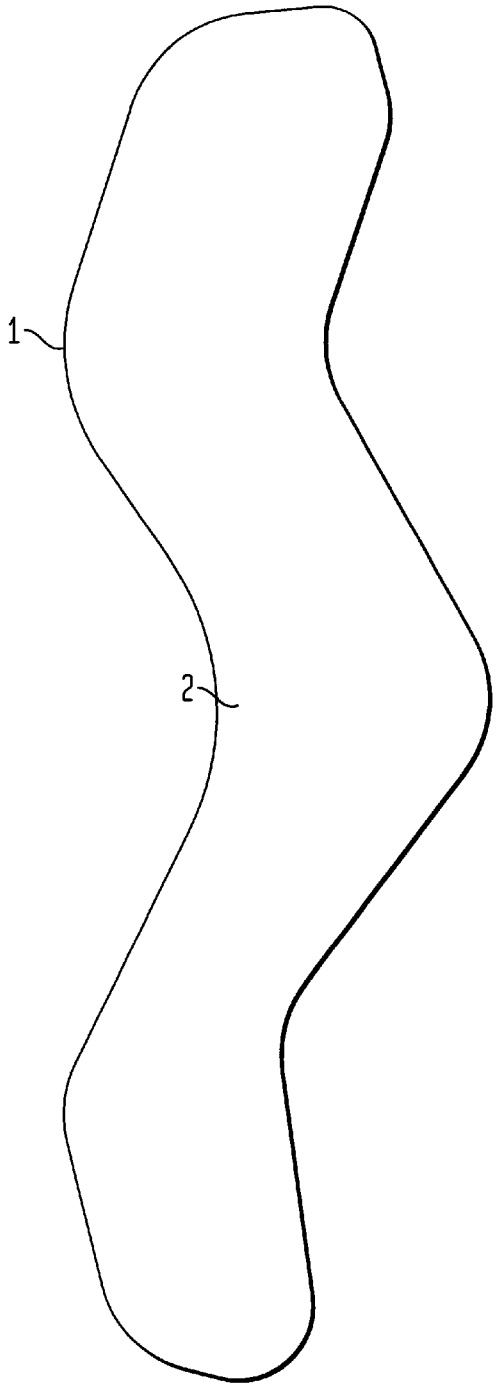
FIG. 8 is a top view of the heat deflection apparatus insert adapted for use in a protective football shoulder pad.
Figure 9:
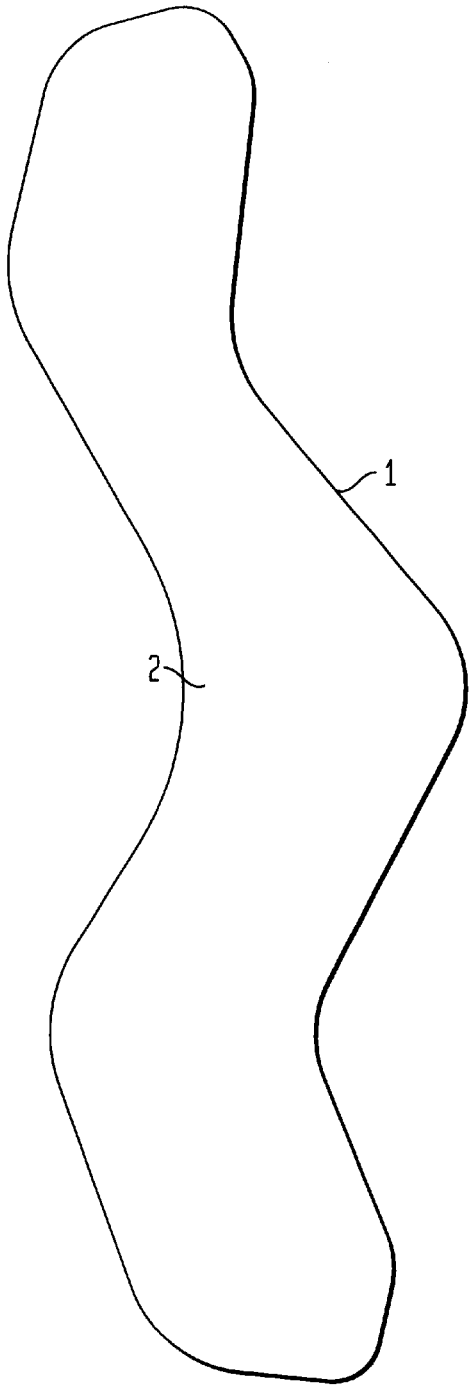
FIG. 9 is a bottom view of the heat deflection apparatus insert adapted for use in a protective football shoulder pad.

FIG. 8 depicts the top portion of the heat deflection apparatus adapted to shoulder pad use wherein substrate 1 has heat deflection material 2 disposed thereon. FIG. 9 depicts the bottom portion of the same apparatus wherein substrate 1 has a suitable backing material 2 disposed thereon.

In a preferred embodiment, the invention relates to a heat deflecting device usable with an impact protecting article comprising a support substrate and a reflecting means disposed on the support substrate, wherein the support substrate has a shape adapted to substantially conform to the shape of at least one portion of an impact protecting device. The heat deflecting device is preferably adapted to substantially conform to the shape of at least a portion of a football protective pad, or a football helmet.

In another preferred embodiment, the invention relates to an athletic article useable by a human being which provides protection from impact comprising a member adapted for a given portion of the user's body, the member including means for deflecting radiant heat energy directed at the outer surface of the article. Preferred athletic articles include football helmets and protective football pads.

In still another preferred embodiment, the invention relates to a heat deflecting helmet comprising: (a) a helmet body adapted to be worn on a person's head, the helmet body having an interior portion and an exterior portion; and (b) a substrate having at least one layer of heat deflection material, the substrate adapted to substantially conform to the shape of at least a portion of the helmet. This includes variations wherein the heat deflecting means is a heat deflecting coating (such as a liquid-applied coating, laminate, or otherwise) which is applied to the interior portion of the protective helmet.

In another preferred embodiment, the invention relates to heat deflecting protective pads comprising a layer having an interior portion and an exterior portion, a heat deflection material disposed within the interior portion, and impact absorbing means disposed within the interior portion.

Preferred heat deflection means are comprised of aluminum, even more preferably, aluminized polyester.

Other applications include lacrosse pads, baseball umpire and catcher chest protectors, hockey pads, athletic clothing, and any other suitable athletic application.

The radiant heat deflection system has many benefits over standard padding and helmets lacking the heat deflection components. For example, the components add virtually no weight to a helmet, padding, or other article. Because the components are very thin, they will not change the fit or sizing of a helmet, padding, or other article. Nor do they alter the protective capabilities of the helmet, padding, or other article. Use of these components also produces a cooler interior helmet temperature, reducing the total heat load imposed on an athlete during extreme heat conditions.

Heat Retention

The invention further relates to inserts as well as an apparatus for retaining heat in an athletic helmet. One preferred embodiment of the heat retaining aspect of the invention comprises an insert having an optional substrate, and 100% pure lambswool that has been ironed, combed, then sheared to a ½ inch to 1 inch pile. The wool is for example laminated to the hook side of Velcro® and can be fastened to a helmet by applying the loop side to the inner portion of the helmet shell and gently applying pressure. The insert is die cut to fit the interior portion of the helmet around the ear holes and the upper interior portion of the helmet on what is commonly referred to as the "deflection pad." Different shapes of the insert correspond to the different models of helmets on the market, and the heat retaining insert is easily applied and removed. By using this insert, the player experiences no sensation of swirling wind in their helmet, and the insulation value of the wool that encompasses the entire ear area inhibits or prevents frostnip or frostbite. The hole in the middle of the apparatus allows sound to pass through the hole, eliminating hearing loss accompanied with current methods. Additionally, the holes permit the player to place their fingers into the holes so the helmet may be removed with ease. Also, the upper portion of the helmet has superior heat retention during periods of inactivity. The player no longer has to put a freezing cold helmet back on when they are ready to resume play. In accordance with the invention, a player can enjoy both warmth and comfort in cold weather.

The heat retaining aspect comprises an optional substrate and at least one layer of heat retaining material. Such material may be natural or synthetic insulating fibers, fur, and the like. These include wool, cotton, sheepskin, and the like. The material may also include Thinsulate®, Gore-tex®, Hollowfill®, or other suitable synthetic insulating materials. The heat retaining material can be permanently or removably secured to the athletic helmet through conventional means such as adhesives, hook-and-loop fasteners (Velcro®), snaps, or other similar securing means.

In a preferred embodiment, the invention relates to a heat retaining insert comprising a heat retaining element substantially adapted to conform to at least a portion of an athletic helmet. Preferred heat retaining materials include sheepskin.

In another preferred embodiment, the invention relates to a heat retaining helmet comprising, (a) a helmet body adapted to be worn on a person's head, the helmet body having an interior portion and an exterior portion; and (b) at least one heat retaining material disposed within the interior portion of the helmet. Preferred heat retaining materials include sheepskin.

Figure 10:
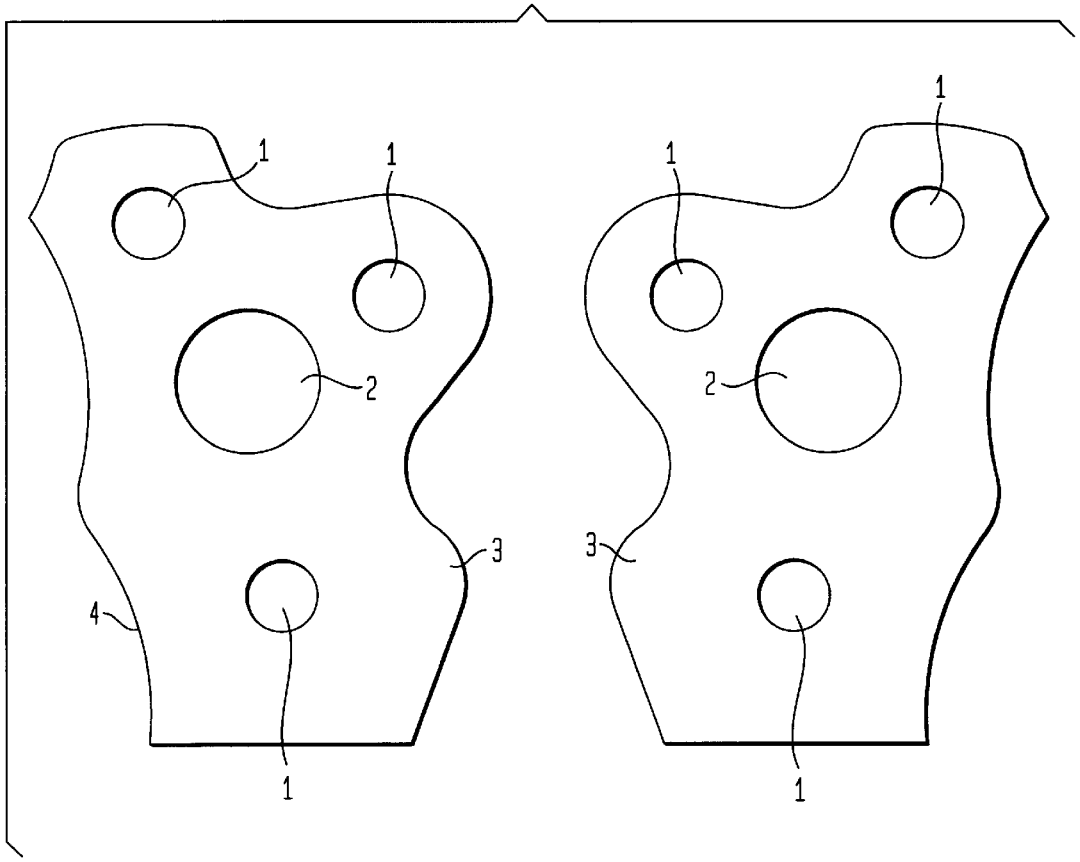
FIG. 10 depicts left and right ear portions of the heat retaining apparatus adapted for use in a protective football helmet.

FIG. 10 depicts left and right ear portions of an exemplary heat retaining apparatus adapted for use in a protective football helmet, wherein the apparatus has a substrate 4, securing points 1, earholes 2, and heat retaining elements 3. The shape of the apparatus is adapted for use in a protective helmet.

Figure 11:
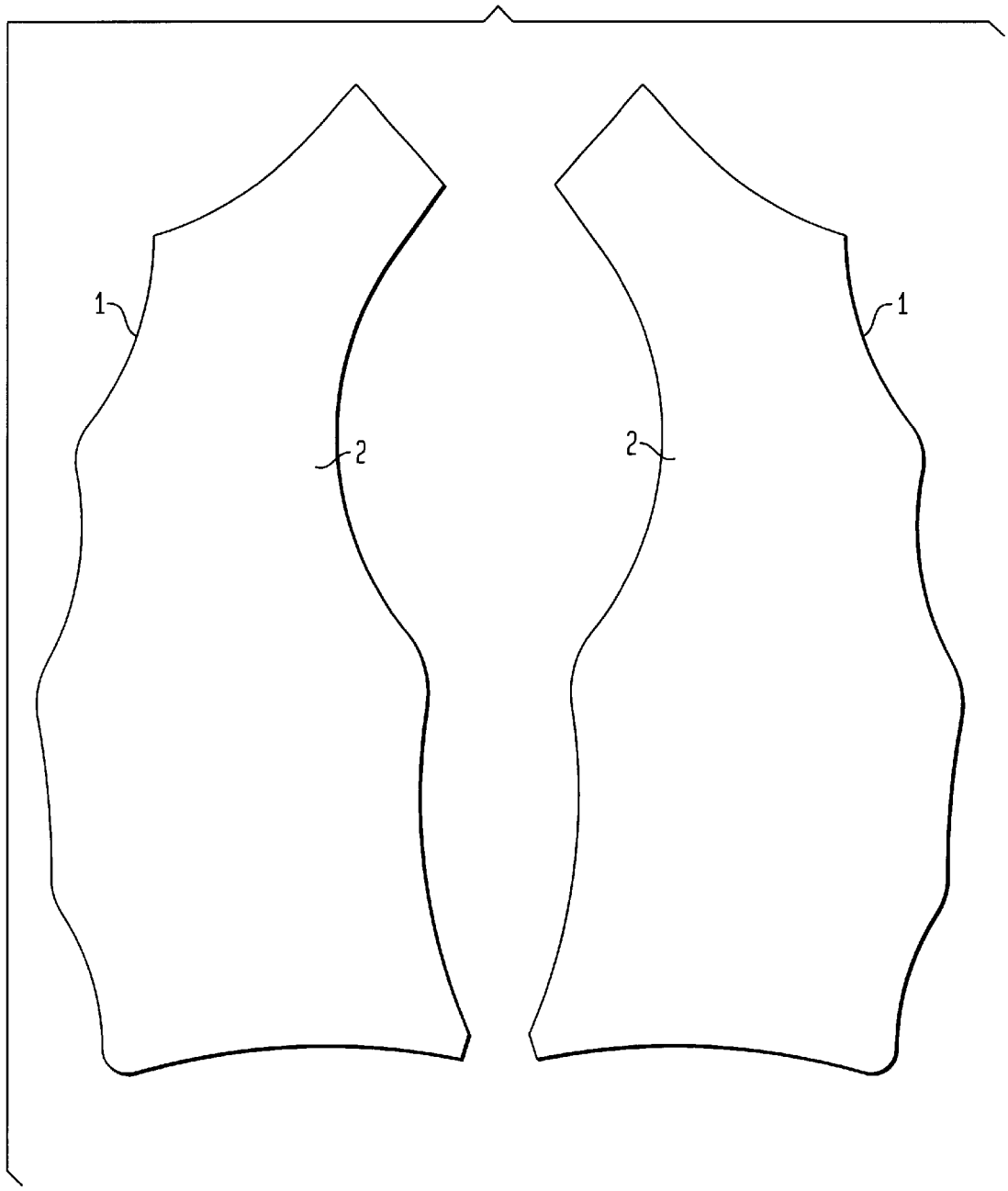
FIG. 11 depicts the left and right portions of an exemplary heat retaining insert adapted for use in a protective football helmet. The insert has heat retaining means 2, and an optional substrate 1. The shape of the insert is adapted for use in the top portion of a protective helmet, Although the shell is translucent in FIGS. 1–7 the present invention is not limited to this feature and may include a helmet having an opaque shell.

FIG. 11 depicts the left and right portions of an exemplary heat retaining insert adapted for use in a protective football helmet. The insert has an optional substrate 1 and heat retaining means 2. The shape of the insert is adapted for use in the top portion ("deflection pad" region) of a protective helmet.

The heat retaining apparatus is not limited to football helmets. Other suitable applications include baseball hats, baseball batting helmets, baseball catchers helmets, lacrosse helmets, motorcycle helmets, bicycle helmets, hockey helmets, auto racing helmets, and any other suitable application where heat retention is desired.

The following example will serve to further typify the nature of the invention but should not be construed as a limitation on the scope thereof

EXAMPLE 1

In a controlled laboratory test, two (2) identical helmets painted in "High-Gloss" metallic Kelly Green paint were placed side-by-side under two (2) 250-watt infrared heat lamps. One helmet was a standard football helmet. The other was lined with the radiant heat deflection system of the instant invention. Using a three (3) probe Digital Thermometer, a probe was placed on the outside of each helmet to measure surface temperature, and one probe was placed on the inside of each of the unlined and radiant heat deflection system (RHDS) lined helmet padding. The following data represents the average surface temperatures for the series of tests:

| | |
|---|---|
| After 10 minutes: | |
| Outside surface temperature (shell): | 121.10° F. |
| Inside temperature of unlined helmet | 75.73° F. |
| Inside temperature of RHDS helmet | 74.33° F. |
| Difference in temperature | 1.40° F. |
| After 20 minutes; | |
| Outside surface temperature | 133.96° F. |
| Inside temperature of unlined helmet | 89.10° F. |
| Inside temperature of RHDS helmet | 81.03° F. |
| Difference in temperature | 8.07° F. |
| After 40 minutes; | |
| Outside surface temperature | 144.43° F. |
| Inside temperature of unlined helmet | 111.00° F. |
| Inside temperature of RHDS helmet | 94.20° F. |
| Difference in temperature | 16.80° F. |
| After 60 minutes: | |
| Outside surface temperature | 155.66° F. |
| Inside temperature of unlined helmet | 119.10° F. |
| Inside temperature of RHDS helmet | 100.10° F. |
| Difference in temperature | 19.00° F. |

Although the invention herein has been described with respect to certain embodiments, it will be understood that these embodiments are merely illustrative of the principles and applications of the present invention. Additional modifications may be made to these embodiments without departing from the spirit of the present invention as set forth in the appended claims.

What is claimed is:

1. A heat deflecting helmet comprising:

a helmet to be worn on a user's head; and a heat deflecting element having at least one sheet of heat reflective foil with a scrim reinforcement;

wherein the heat deflecting element is sized and shaped to substantially conform to at least a portion of the helmet.

2. The heat deflecting helmet of claim 1, further comprising an adhesive layer, wherein the at least one sheet of heat reflective foil with the scrim reinforcement are laminated to the adhesive layer.

3. The heat deflecting helmet of claim 1, wherein the portion is an interior portion of the helmet.

4. The heat deflecting helmet of claim 1, wherein the at least one sheet of heat reflective foil is comprised of aluminum foil.

5. The heat deflecting helmet of claim 1, wherein the at least one sheet of heat reflective foil comprises two sheets of heat reflective foil.

6. The heat deflecting helmet of claim 5, wherein the two sheets of heat reflective foil are each comprised of aluminum foil.

7. The heat deflecting helmet of claim 1, wherein the scrim reinforcement is comprised of fiberglass.

8. The heat deflecting helmet of claim 2, wherein the adhesive layer is pressure sensitive.

9. The heat deflecting helmet of claim 2, wherein the adhesive layer is comprised of a cotton/polyester pressure sensitive adhesive tape.

10. A heat deflecting athletic pad for impact protection, the heat deflecting athletic pad comprising:

an athletic pad to be worn on a user's body;

a heat deflecting element having at least one sheet of heat reflective foil with a scrim reinforcement;

wherein the heat deflecting element is sized and shaped to substantially conform to at least a portion of the athletic pad.

11. The heat deflecting athletic pad of claim 10, further comprising an adhesive layer, wherein the at least one sheet of heat reflective foil with the scrim reinforcement are laminated to the adhesive layer.

12. The heat deflecting athletic pad of claim 11, wherein the adhesive layer is pressure sensitive.

13. The heat deflecting athletic pad of claim 11, wherein the adhesive layer is comprised of a cotton/polyester pressure sensitive adhesive tape.

14. The heat deflecting athletic pad of claim 10, wherein the at least one sheet of heat reflective foil is comprised of aluminum foil.

15. The heat deflecting athletic pad of claim 10, wherein the at least one sheet of heat reflective foil comprises two sheets of heat reflective foil.

16. The heat deflecting athletic pad of claim 15, wherein the two sheets of heat reflective foil are each comprised of aluminum foil.

17. The heat deflecting athletic pad of claim 10, wherein the scrim reinforcement is comprised of fiberglass.

18. The heat deflecting athletic pad of claim 10, wherein the athletic pad comprises a shoulder pad.

19. The heat deflecting athletic pad of claim 10, wherein the athletic pad comprises a football shoulder pad.

* * * * *